US010900488B2

(12) United States Patent
Wang

(10) Patent No.: US 10,900,488 B2
(45) Date of Patent: Jan. 26, 2021

(54) INTELLIGENT CLOGGING-FREE WATER-COOLED MULTIFUNCTIONAL PUMP

(71) Applicant: GP Enterprises Co., Ltd, Jiangsu (CN)

(72) Inventor: Xian Wang, Jiangsu (CN)

(73) Assignee: GP Enterprises Co., Ltd, Suzhou (CN)

( * ) Notice: Subject to any disclaimer, the term of this patent is extended or adjusted under 35 U.S.C. 154(b) by 251 days.

(21) Appl. No.: 16/128,509

(22) Filed: Sep. 12, 2018

(65) Prior Publication Data

US 2018/0372122 A1 Dec. 27, 2018

Related U.S. Application Data

(63) Continuation-in-part of application No. PCT/CN2017/088160, filed on Jun. 13, 2017.

(30) Foreign Application Priority Data

May 23, 2017 (CN) ..... 2017 2 0575919 U

(51) Int. Cl.

| | |
|---|---|
| ***F04D 29/70*** | (2006.01) |
| ***F04D 29/22*** | (2006.01) |
| ***F04D 29/44*** | (2006.01) |
| ***F04D 13/02*** | (2006.01) |
| ***F04D 29/24*** | (2006.01) |
| ***F04D 1/14*** | (2006.01) |
| ***F04D 29/42*** | (2006.01) |

(Continued)

(52) U.S. Cl.

CPC ..... *F04D 13/08* (2013.01); *F04D 1/14* (2013.01); *F04D 13/02* (2013.01); *F04D 29/2216* (2013.01); *F04D 29/2227* (2013.01); *F04D 29/247* (2013.01); *F04D 29/4273* (2013.01); *F04D 29/445* (2013.01); *F04D 29/708* (2013.01); *F04D 29/5806* (2013.01)

(58) Field of Classification Search

CPC ..... F04D 13/02; F04D 13/08; F04D 29/2216; F04D 29/2227; F04D 29/247; F04D 29/4273; F04D 29/445; F04D 29/708; F04D 1/14; F04D 29/5806

See application file for complete search history.

(56) References Cited

U.S. PATENT DOCUMENTS

2018/0372122 A1* 12/2018 Wang ..... F04D 13/02

FOREIGN PATENT DOCUMENTS

| | | |
|---|---|---|
| CN | 202056041 U | 11/2011 |
| CN | 103016361 A | 4/2013 |

* cited by examiner

*Primary Examiner* — J. Todd Newton
*Assistant Examiner* — Christopher R Legendre

(57) ABSTRACT

An intelligent control clogging-free water-cooled multifunctional pump includes a housing, a water-through tank, a motor, an axial flow style cover plate, a flexible rubber conical impeller, a double-channel conical diffuser, a filter and an intelligent water level controller. The motor is placed inside the housing. The motor is provided with a control board. The water-through tank is placed under the housing. The flexible rubber conical impeller is coaxially connected to the motor. The axial flow style cover plate is placed at the bottom of the water-through tank. The double-channel conical diffuser is disposed under the cover plate and the conical pattern of the flexible rubber impeller is consistent with the conical pattern of the double-channel conical diffuser.

7 Claims, 4 Drawing Sheets

(51) Int. Cl.
*F04D 29/58* (2006.01)
*F04D 13/08* (2006.01)

INTELLIGENT CLOGGING-FREE WATER-COOLED MULTIFUNCTIONAL PUMP

CROSS REFERENCE TO RELATED APPLICATIONS

The present application is a Continuation-In-Part Application of PCT Application No. PCT/CN2017/088160 filed on Jun. 13, 2017, which claims the benefit of Chinese Patent Application No. 201720575919.2 filed on May 23, 2017. All the above are hereby incorporated by reference.

TECHNICAL FIELD

The present invention is relates to a water pump, and specifically relates to an intelligent, clogging-free and water-cooled multifunctional pump which belongs to the technical field of water pump.

BACKGROUND OF THE INVENTION

In the United States and Europe household water pump industry, multifunctional pump clogging by foreign materials during application is a very common issue and this issue has been troubling pump subscribers and makers. The clearance between impeller and tank is designed very small, in case of particles falls within the tank, pump impeller is easy to be jammed when start-up. The impeller and tank are made of hard material such as plastic, casting, etc. They are not able to bypass particles inside that resulting in motor burning out and returning.

SUMMARY OF THE INVENTION

The purpose of the present invention is to provide a flexible rubber conical impeller which can bounce off hard particles sucked inside and prevent pump from clogging, the double flow channel conical diffuser provides bidirectional diverging channel and its conical bottom is to avoid impurities accumulating, utilizing the own water cycle to cool motor, it also provides automatically turning on pump when detecting water and stopping pump when it is out of water, this invention prevents pump from burning damage due to clogging by foreign particle substance sucked in and prolongs the service life of pump correspondingly.

The technical solution of the present invention is to provide an intelligent, clogging-free, water-cooled multifunctional pump which includes a housing, a U-shape water-through tank, a motor, an axial flow style cover plate, a flexible rubber conical impeller, a double-channel conical diffuser, a filter and an intelligent water level controller, the motor which contains a control panel is disposed inside the housing and sealed by an O-ring, the U shape water-through tank is disposed under the housing and connects to the housing via screws, the flexible rubber conical impeller coaxially connects to the motor, the axial flow style cover plate is disposed at the bottom of the U-shape water-through tank, the double-channel conical diffuser is disposed under the cover plate and connects to the U shape water-through tank via screws, the filter is disposed under the double-channel conical diffuser and connects thereto via screws, the intelligent water level controller is placed outside of U-shape tank and connects with the housing via slip snap joint structure, the conical pattern of the flexible rubber impeller is consistent with those of the double-channel diffuser, when foreign particles go inside the diffuser and landing on the 0-180° conical surface, the particles drop out along the conical surface; when particles encountered in the process of pumping water, the flexible rubber conical impeller expels the particles utilizing its flexibility.

In a preferred embodiment of the present invention, the U-shape water-through tank is provided with water-blocking board and water discharging outlet, the water-blocking board is disposed around the U-shape water-through tank, the inside of the tank is designed as a U shape.

In a preferred embodiment of the present invention, the motor shielded in a housing and the housing installed inside the U-shape water-through tank.

In a preferred embodiment of the present invention, the axial flow style cover plate is provided with 1-10 axial flowing holes for water going through, the hole is in the shape of any one of circular, square, rectangular, oval or others.

In a preferred embodiment of the present invention, the flexible rubber conical impeller is provided with 1-20 flexible blades which are in the angle of 0-180° conical structure and the back of impeller is provided with 1-10 auxiliary blades, the impeller is made of rubber.

In a preferred embodiment of the present invention, the double-channel conical diffuser is provided with a water inlet, filter grids, a conical surface, conical flow channels, location holes and assembly holes. The conical surface is in the angle of 0°-180°, the number of the conical flow channels is 1-10.

In a preferred embodiment of the present invention, the intelligent water level controller is equipped with a control box, a control box lid, a probe assembly. The probe assembly comprises a high water level probe, a low water level probe, a common probe and signal lines. The probe assembly connects to the control box via snap joint structure. The intelligent water level controller is connected to the control panel via signal lines. The high water level probe, the low water level probe and the common probe are made of any material of stainless steel, copper, composite metal materials, or other conductive composite materials.

The present invention is relates to an intelligent control, clogging-free, water cooled multifunctional pump which provided with a flexible rubber conical impeller that can bounce off hard particles coming inside so as to prevent pump from clogging, on the other hand, the double flow channel conical diffuser provides bidirectional diverging channel and its conical bottom is able to avoid impurities accumulating, meanwhile, utilizing the own water cycle to cool the motor, it also provides automatically turning on pump when detected water and stopping pump when it is out of water. This invention prevents the pump from burning damage which caused by clogging by foreign particle substance sucked in and prolongs the service life of pump correspondingly.

BRIEF DESCRIPTION OF THE FIGURES

In order to more clearly illustrate the technical solutions in the embodiments of the present invention, the drawings used in the description of the embodiments will be briefly described below, obviously, the drawings in the following description are merely some embodiments of the present invention. For those who skilled in the art, other drawings may also be obtained based on these drawings without paying any creative work. Therein.

DETAILED DESCRIPTION

The following is clearly and completely describes of the technical solutions in the embodiments of the present invention in order to that the advantages and characteristics of the present invention can be understood easily by the technicians in this field and can clearly define the protection scope of the present invention.

Figure 1:
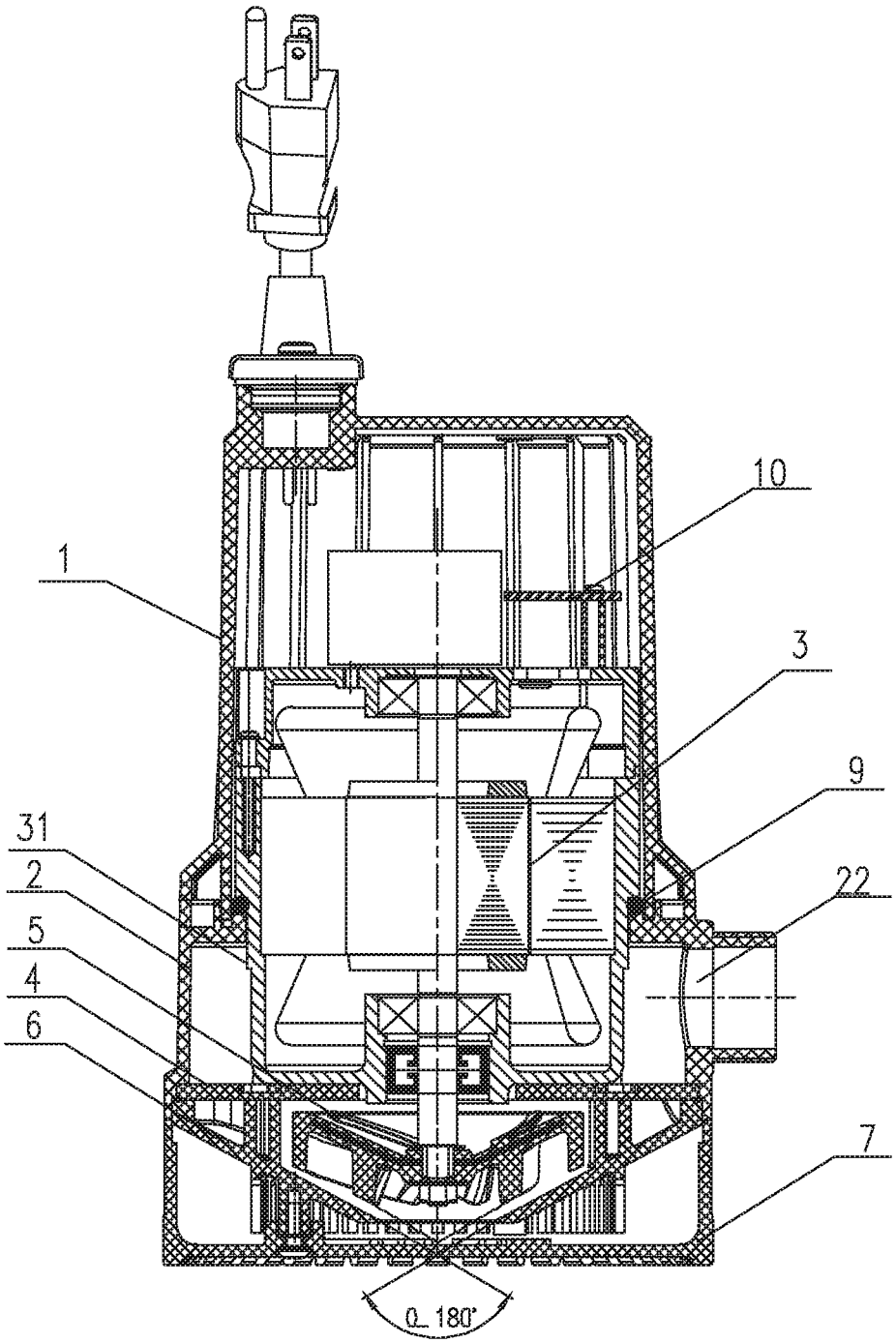
FIG. 1 is a schematic structural view of a preferred embodiment of the intelligent control, clogging-free, water-cooled multifunctional pump according to the present invention.
Figure 2:
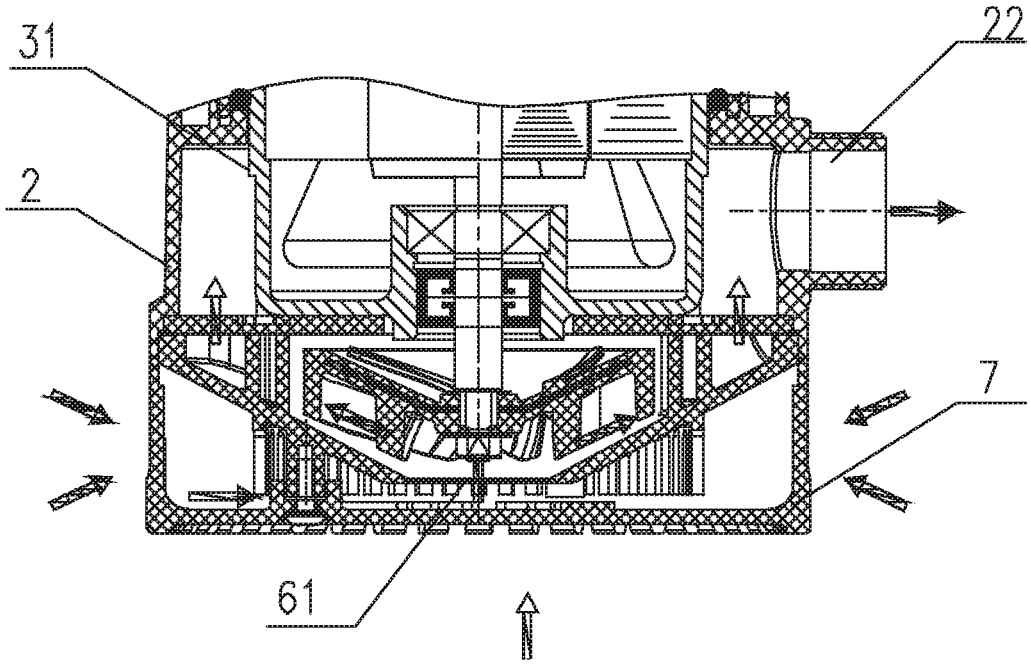
FIG. 2 is a schematic structure view of the lower part of FIG. 1.
Figure 3:
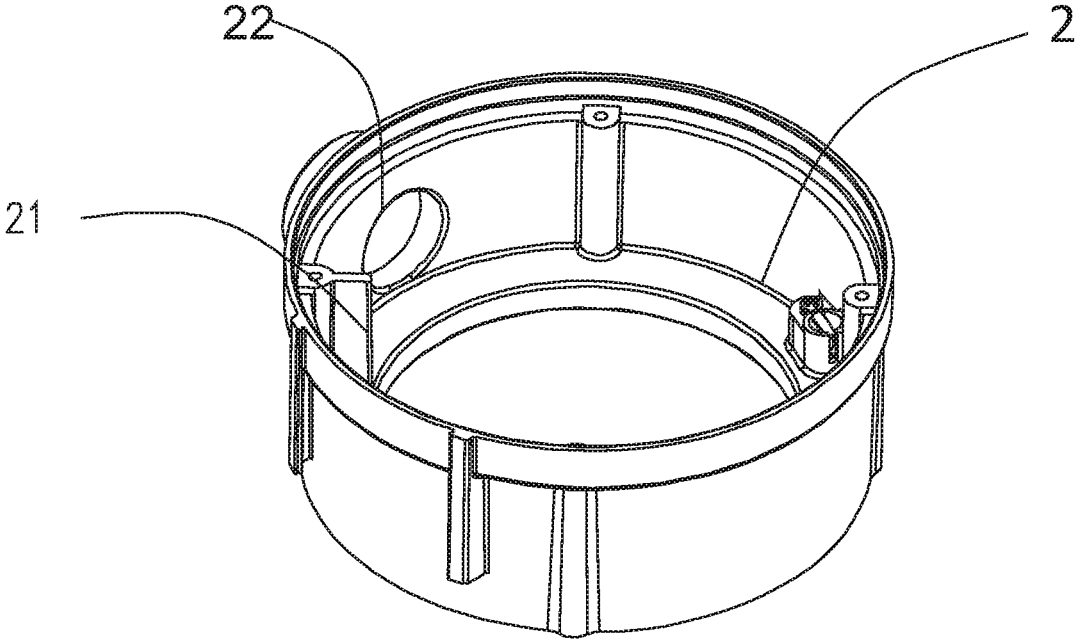
FIG. 3 is a schematic structural view of the U-shaped water-through tank of the intelligent control, clogging-free, water-cooled multifunctional pump according to the present invention.
Figure 4:
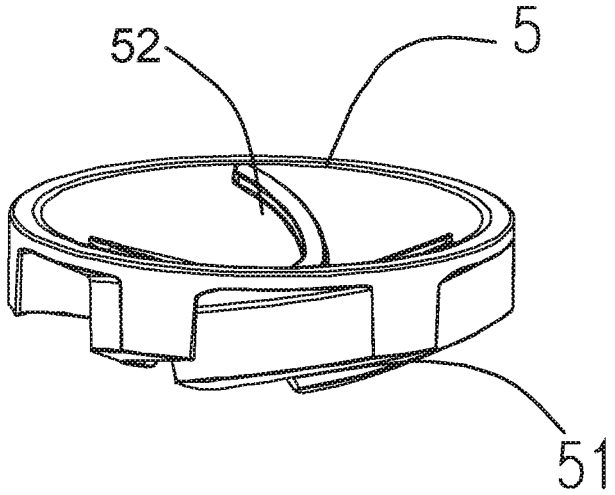
FIG. 4 is a schematic structural view of the flexible rubber conical impeller of the intelligent control, clogging-free, water-cooled multifunctional pump according to the present invention.
Figure 5:
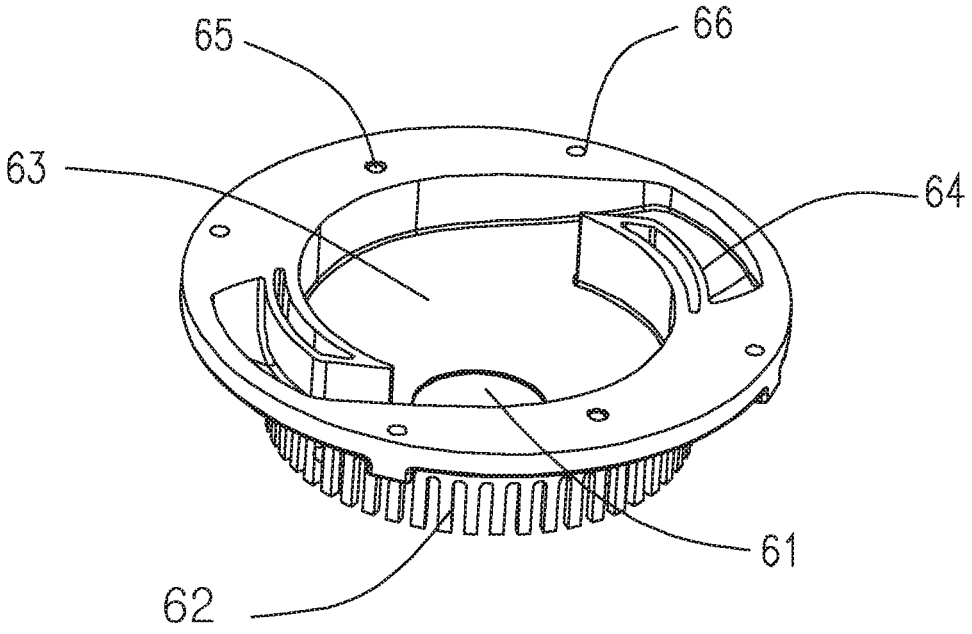
FIG. 5 is a schematic structural view of the double channel conical diffuser of the intelligent control, clogging-free, water-cooled multifunctional pump according to the present invention.
Figure 6:
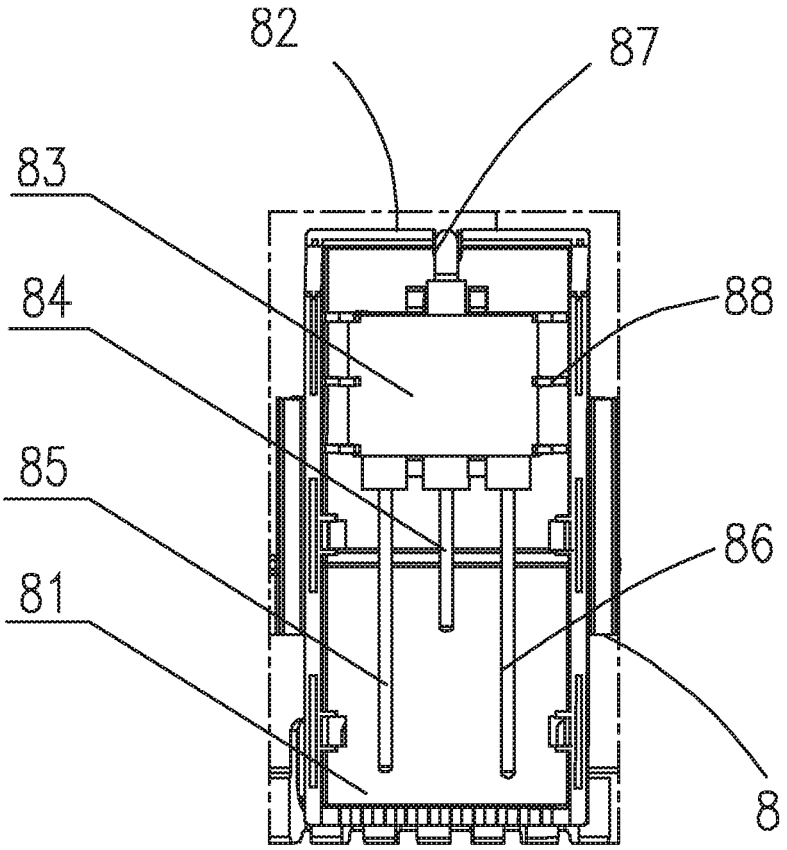
FIG. 6 is a schematic structural view of the intelligent water level controller of the intelligent control, clogging-free, water cooled multifunctional pump according to the present invention.

The present invention relates to an intelligent control, clogging-free, water-cooled multifunctional pump as FIG. 1 and reference to FIG. 2-6, including a housing 1, a U-shape water-through tank (2), a motor 3, an axial flow style plate cover 4, a flexible rubber conical impeller 5, a double-channel conical diffuser 6, a filter 7, and an intelligent water level controller 8. The motor 3 which contains a control panel 10 is disposed inside the housing 1 and sealed by an O-ring 9. The U shape water-through tank 2 is disposed under the housing 1 and connects to the housing 1 via screws. The flexible rubber conical impeller 5 coaxially connects to the motor 3. The axial flow style plate cover 4 is placed at the bottom of the U-shape water-through tank 2. The double-channel conical diffuser 6 is disposed under the cover plate 4 and connects to the U shaped water through tank 2 via screws. The filter 7 is disposed under the double-channel conical diffuser 6 and connects thereto via screws. The intelligent water level controller 8 is placed outside of U-shape tank 2 and connects with the housing 1 via slip snap joint structure. The conical pattern of the flexible rubber impeller 5 is consistent with those of the double-channel diffuser 6, when foreign particles go inside the diffuser 6 and landing on the 0°-180° conical surface, the particles slip out along the conical surface. When particles encountered in the process of pumping water, the flexible rubber conical impeller bounces off the particles utilizing its elasticity so as to prevent clogging.

The U-shape water-through tank 2 is provided with water-blocking board 21 and water discharging outlet 22, the water-blocking board 21 is disposed around the U-shape water-through tank 2, the inside of the tank 2 is designed as a U shape.

The motor 3 is provided with a motor housing 31 and the motor housing 31 is placed inside of the U-shape water-through tank 2.

The axial flow style cover plate 4 is provided with 1-10 axial flowing holes for water through and the hole is in the shape of any one of circular, square, rectangular, oval or others.

The flexible rubber conical impeller 5 is provided with 1-20 flexible blades 51, the flexible blades 51 is in the structure of 0°-180° conical structure and the back of impeller 5 is provided with 1-10 auxiliary blades 52, the impeller is made of rubber.

The double-channel conical diffuser 6 is provided with a water inlet 61, filter grids 62, a conical surface 63, conical flow channels 64, location holes 65 and assembly holes 66, described the conical surface 63 is in the angle of 0°-180°, the number of the conical flow channels 64 1-10.

The intelligent water level controller 8 is equipped with a control box 81, a control box lid 82, a probe assembly 83, the probe assembly 83 comprises a high water level probe 84, a low water level probe 85, a common probe 86 and signal lines 87. The probe assembly 83 connects to the control box 81 via snap joint structure 88. The intelligent water level controller 8 is connected to the control panel 10 via signal lines 87. The high water level probe 84, the low water level probe 85 and the common probe 86 are made of any material of stainless steel, copper, composite metal materials, or other conductive composite materials.

The intelligent control system automatically detects water to and accordingly decide to start pumping or stop when detects water is empty. This pump can always be in standby state or working without users' manipulating, so users can leave when pump is working. When water accumulated, the pump automatically detects the water level and automatically starts pumping and stops after water is empty.

The motor housing is treated with corrosion protection and dissipates heat from the motor housing to water by contacting with circulating water.

The present invention is relates to an intelligent control, clogging-free, water-cooled multifunctional pump provided with a flexible rubber conical impeller which can bounce off hard particles inside to prevent pump from clogging. The double flow channel conical diffuser provides bidirectional diverging channel and its conical bottom is able to avoid impurities accumulating. The invention utilizes the own water cycle to cool motor, it also provides automatically turning on to pump when detected water and stopping to pump when detected out of water. This invention prevents pump from burning damage caused by clogging as of foreign particle substance sucked in so prolongs the service life of pump correspondingly.

The foregoing descriptions are merely embodiments of the present invention, and therefore do not mean to limit the scope of the present invention. Any implementation on the content of the present specification by using an alternative structure or equivalent process transformation without any creative labor should be covered within the scope of protection of the present invention. Therefore, the scope of protection of the invention shall be subject to the scope of protection specified in the patent claim.

What is claimed is:

1. An intelligent control clogging free water-cooled multifunctional pump, comprising a housing, a water-through tank, a motor, an axial flow style cover plate, a flexible rubber conical impeller disposed inside a pumping chamber, a double-channel conical diffuser, a filter and an intelligent water level controller; wherein the motor contains a control panel which is disposed inside the housing and wherein an O-ring is disposed between the motor and the housing; the water-through tank is disposed under the housing and connects to the housing; the flexible rubber conical impeller coaxially connects to the motor; the axial flow style cover plate is disposed at a bottom of the water-through tank; the double-channel conical diffuser is disposed under the axial flow style cover plate and connects to the water-through tank; the filter is disposed under the double-channel conical diffuser and connects to the double-channel conical diffuser; the intelligent water level controller is placed outside of the water-through tank and connects with the housing, a conical pattern of the flexible rubber conical impeller is consistent with a conical pattern of the double-channel conical diffuser, wherein during operation of the intelligent control clogging free water-cooled multifunctional pump, when foreign particles go inside the double-channel conical diffuser and land on a 0°-180° conical surface, the foreign particles slip out from the double-channel conical diffuser along the conical surface; and during the operation of the intelligent control clogging free water cooled multifunctional pump, when particles go inside the pumping chamber the flexible rubber conical impeller expels the particles out from the pumping chamber.

2. The intelligent control clogging free water-cooled multifunctional pump according to claim 1, characterized in that the water-through tank is provided with a water-blocking board and a water discharging outlet, the water-blocking board is disposed around the water-through tank inside of the tank is designed as a U shape.

3. The intelligent control clogging free water-cooled multifunctional pump according to claim 1, characterized in that the motor is shielded in the housing and the housing is installed inside the water-through tank.

4. The intelligent control clogging free water-cooled multifunctional pump according to claim 1, characterized in that the axial flow style cover plate is provided with 1-10 axial flowing holes and each hole is in a shape of any one of circular, square, rectangular, and oval.

5. The intelligent control clogging free water-cooled multifunctional pump according to claim 1, characterized in that the flexible rubber conical impeller is provided with 1-20 flexible blades which are in an angle of 0°-180° conical structure and a back of the flexible rubber conical impeller is provided with 1-10 auxiliary blades.

6. The intelligent control clogging free water-cooled multifunctional pump according to claim 1, characterized in that the double-channel conical diffuser is provided with a water inlet, a filter grid, the 0°-180° conical surface, conical flow channels, a location hole and an assembly hole; and wherein a number of the conical flow channels is 1-10.

7. The intelligent control clogging free water-cooled multifunctional pump according to claim 1, characterized in that the intelligent water level controller is equipped with a control box, a control box lid, and a probe assembly, and wherein the probe assembly comprises a high water level probe, a low water level probe, a common probe and signal lines; wherein the probe assembly connects to the control box; the intelligent water level controller is connected to a control panel via signal lines; the high water level probe, the low water level probe and the common probe are made of any material of stainless steel, copper, and composite metal materials.

* * * * *